US005465456A

United States Patent [19]

Fellhauer et al.

[11] Patent Number: 5,465,456

[45] Date of Patent: Nov. 14, 1995

[54] FLOOR CLEANING APPARATUS

[75] Inventors: Jeffery R. Fellhauer, Toledo; Michael W. Savidge, Northwood, both of Ohio

[73] Assignee: National Super Service Company, Toledo, Ohio

[21] Appl. No.: 314,931

[22] Filed: Sep. 29, 1994

Related U.S. Application Data

[63] Continuation of Ser. No. 856,560, Mar. 24, 1992, abandoned.

[51] Int. Cl.[6] ..... A47L 7/00

[52] U.S. Cl. ..... 15/320; 15/340.2; 15/340.3; 15/355; 15/359; 15/50.1; 239/151; 239/159; 239/172; 239/754

[58] Field of Search ..... 15/50.3, 52.1, 15/82, 320–322, 328, 340.2, 340.3, 340.4, 354, 355, 359, 360, 49.1, 50.1, 51, 87, 401; 239/151, 159, 172, 754

[56] References Cited

U.S. PATENT DOCUMENTS

| | | | |
|---|---|---|---|
| 613,296 | 11/1898 | Ober et al. | 239/159 |
| 943,881 | 12/1909 | Kern, Jr. | 15/340.3 X |
| 2,256,986 | 9/1941 | Likshis | 15/50.3 |
| 3,019,462 | 2/1962 | Nash et al. | 15/401 X |
| 3,065,490 | 11/1962 | Arones | 15/359 |
| 3,709,436 | 1/1973 | Foster | 239/754 |
| 3,726,481 | 4/1973 | Foster et al. | 239/754 |
| 3,729,908 | 5/1973 | Miner | 15/320 X |
| 3,797,600 | 3/1974 | Miner . | |
| 3,837,029 | 9/1974 | Kasper | 15/340.3 X |
| 3,939,518 | 2/1976 | Whitney et al. | 15/320 X |
| 3,942,214 | 3/1976 | Maasberg | 15/320 |
| 3,987,964 | 10/1976 | Pittman et al. | 239/754 |
| 4,167,799 | 9/1979 | Webb | 15/320 |
| 4,186,879 | 2/1980 | Kinder | 239/159 |
| 4,234,995 | 11/1980 | Parise | 15/359 X |
| 4,293,971 | 10/1981 | Block | 15/359 X |
| 4,334,336 | 6/1982 | Harbeck et al. | 15/322 |
| 4,339,841 | 7/1982 | Waldhauser et al. | 15/320 X |
| 4,360,946 | 11/1982 | Marshall, Jr. et al. | 15/354 X |
| 4,492,002 | 1/1985 | Waldhauser et al. | 15/401 X |
| 4,527,739 | 7/1985 | Parma et al. | 15/320 X |
| 4,580,312 | 4/1986 | Van Raaij | 15/354 X |
| 4,596,061 | 6/1986 | Henning | 15/322 |
| 4,619,010 | 10/1986 | Burgoon | 15/320 X |
| 4,620,341 | 11/1986 | Rigby | 15/340.3 X |
| 4,643,261 | 2/1987 | Long | 15/82 X |
| 4,649,594 | 3/1987 | Grave | 15/321 X |
| 4,679,271 | 7/1987 | Field et al. | 15/320 X |
| 4,953,254 | 9/1990 | Kohl et al. | 15/320 |
| 4,956,891 | 9/1990 | Wulff | 15/321 X |
| 5,125,128 | 6/1992 | Davis | 15/340.4 |

FOREIGN PATENT DOCUMENTS

| | | | |
|---|---|---|---|
| 117295 | 4/1930 | Austria | 15/401 |
| 871803 | 5/1971 | Canada | 15/50.3 |
| 53-67263 | 6/1978 | Japan | 15/50.3 |

*Primary Examiner*—Stephen F. Gerrity
*Attorney, Agent, or Firm*—MacMillan, Sobanski & Todd

[57] ABSTRACT

Mobile floor cleaning apparatus of the type having a nozzle assembly for spraying a cleaning solution on carpet or other floor covering, a motor driven brush for scrubbing the wet floor, and a vacuum system for extracting dirty solution from the floor. The nozzle assembly and brush are mounted on a housing which moves in a direction transverse to the direction of movement of the apparatus. The housing extends from one side of the apparatus and deflects in a direction transverse to the direction of movement of the floor cleaning apparatus upon contact with an obstacle. The nozzle assembly includes a spray jet bar mounting a plurality of nozzles. The spray jet bar is releasably mounted on the brush housing to facilitate nozzle maintenance. A vacuum extractor shoe is releasably mounted to swing and swivel from a rear end of the floor cleaning apparatus to automatically adjust to floor irregularities and to maintain maximum floor contact when turning.

15 Claims, 3 Drawing Sheets

FLOOR CLEANING APPARATUS

CROSS REFERENCE TO RELATED APPLICATION

This application is a continuation of application Ser. No. 07/856,560, filed Mar. 24, 1992, now abandoned.

TECHNICAL FIELD

The invention relates to floor cleaning apparatus such as carpet cleaners and more particularly to an improved high capacity carpet cleaner of the type which sprays a cleaning solution onto the carpet, brushes or scrubs the wet carpet with a rotating brush and extracts moisture and dirt from the carpet.

BACKGROUND ART

Hotels, convention centers, office buildings, large restaurants, and similar buildings often have large areas of carpet which must be frequently cleaned. The carpet may be dry vacuumed daily and more thoroughly cleaned as needed or on a regular schedule. Industrial grade carpet cleaners typically included a self propelled chassis which carries a cleaning solution reservoir, a pump driven sprayer for spraying cleaning solution onto the carpet, a motor driven brush for beating the wet carpet and a vacuum extractor and recovery tank for removing and collecting liquid and dirt from the carpet.

Although existing industrial grade carpet cleaners are effective at cleaning, they are sometimes awkward to use because of their size and may be difficult to maintain. The carpet cleaner should be designed as a compact, easy to maneuver machine which will not cause damage when cleaning next to furniture and walls. During use, the spray nozzles sometimes become clogged with dirt and dried cleaning solution. Access to the nozzles for cleaning has often been difficult. Further, a vacuum shoe which extracts fluid and dirt from the carpet should be easily removed for cleaning.

Similar floor cleaning apparatus is often used by institutions for cleaning tile floors and the tile grout.

DISCLOSURE OF THE INVENTION

According to the invention an improved industrial grade floor cleaning apparatus is designed for easy maneuverability during use and for easy maintenance. The cleaner includes a solution spray jet bar for spraying a cleaning solution onto, for example, a carpet, a motor driven brush for brushing or scrubbing the wet carpet, and a vacuum system for extracting dirty solution from the carpet. The solution spray jet bar and the brush are mounted on a brush housing which can move in a direction transverse to the direction of movement of the carpet cleaner. The housing is spring biased to extend from one side of the carpet cleaner to facilitate cleaning close to walls and furniture. Upon contact with an obstacle, the housing deflects in a direction transverse the direction in which the carpet cleaner is moving. Consequently, the risk of damage to furniture and walls is minimized.

The solution spray jet bar includes a tube mounting a plurality of nozzles. A bracket and a quick connect fluid fitting are secured to the tube for releasably mounting the bar on the beater housing to facilitate nozzle maintenance. A weighted vacuum shoe is mounted with a ball and socket assembly to pivot from a rear end of the carpet cleaner. A mechanism permits raising and lowering the ball and socket assembly to allow the vacuum shoe to be pulled over the carpet while maintaining flat contact with the carpet for maximum extraction efficiency. A quick connect coupling or a threaded rod and removable knob between the vacuum shoe and the ball and socket assembly and a removable vacuum hose facilitate removal of the vacuum shoe for maintenance, storage and transportation of the carpet cleaner.

Accordingly, it is an object of the invention to provide improved floor cleaning apparatus.

Other objects and advantages of the invention will be apparent from the following detailed description and the accompanying drawings.

BEST MODE FOR CARRYING OUT THE INVENTION

Figure 1:
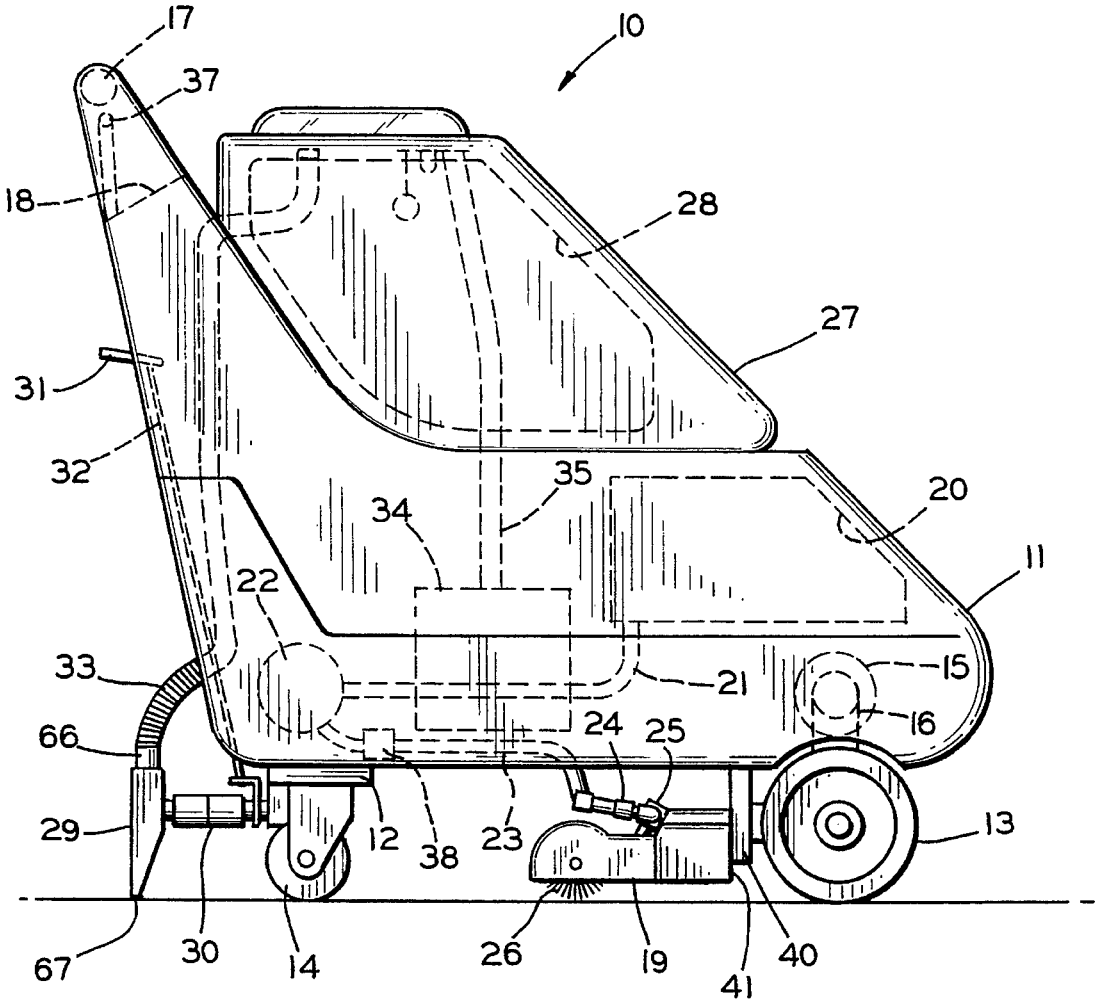
FIG. 1 is a side elevational view of a carpet cleaner according to the invention.

Referring now to FIG. 1 of the drawings, a carpet cleaner 10 is illustrated according to the invention. Although the following description is directed to the carpet cleaner 10, the invention is more broadly directed to floor cleaning apparatus which may be used to clean other types of floor coverings in addition to carpets. The carpet cleaner 10 has a lower housing 11 covering a chassis 12. The chassis 12 is supported on a pair of driven front wheels 13 and a pair of rotatable rear casters or swivel wheels 14. A motor 15 is connected through a chain 16 or other means for driving the front wheels 13. During operation, a worker stands behind the carpet cleaner 10 and grasps a handle 17. While the driven wheels 13 move the carpet cleaner 10 in a forward direction, the worker steers by moving the handle 17 in a desired direction. A control panel 18 adjacent the handle 17 allows the worker to control operation of the carpet cleaner 10.

A carpet brush housing 19 is supported from the chassis 12 to extend between the wheels 13 and 14 in a direction transverse to the housing 11. A reservoir 20 in the lower housing 11 holds a volume of cleaning solution. The reservoir 20 is connected through a hose 21, a pump 22, a hose 23 and a quick connect fitting 24 to a solution spray jet bar 25. The brush housing 19 also mounts a driven brush 26 which beats the carpet after it is sprayed with cleaning solution. The solution pump 22 also may be connected to a manual wand (not shown) for pre-spraying traffic lanes and other heavily soiled areas.

An upper housing 27 is mounted on the lower housing 11. The upper housing 27 forms a recovery tank 28 for collecting solution and dirt extracted from carpet during the cleaning operation. A vacuum shoe 29 is detachably mounted on the carriage 12 by a quick connect fitting 30. A lever 31 and cable 32 are connected for raising and lowering the vacuum shoe 29 and a similar lever and cable (not shown) raises and lowers the brush housing 19. The vacuum shoe 29 and the brush housing 19 may be raised, for example, when the carpet cleaner 10 is moved between jobs. When, the vacuum shoe 29 is lowered, it's weight floats on the carpet to maintain maximum extraction efficiency as it is dragged across the carpet. The vacuum shoe 29 is part of a vacuum system including a hose 33 connecting the vacuum shoe 29 to an inlet side of the recovery tank 28 and a hose 35 connecting an inlet from the suction pump 34 to the recovery tank 28. As the vacuum shoe 29 is dragged over the carpet, dirt and cleaning solution are extracted from the carpet by the shoe 29 and collected in the recovery tank 28.

The control panel 18 has mounted thereon switches (not shown) for controlling the speed of the drive motor 16, the suction pump 34, the solution pump 22 and a motor 36 (FIG. 2) for rotating the brush 26. Further, a deadman lever 37 extends to adjacent the handle 17. In operation, a worker fills the reservoir 20 with a mixture of water and a suitable cleaning solution. By grasping the handle 17 and squeezing the deadman lever 37, the drive motor 15 is energized to drive the carpet cleaner 10 to a desired starting location. The worker releases the deadman lever 37 to stop the carpet cleaner 10. Switches are actuated for the solution pump 22, the suction motor 34 and the brush motor 36. However, the brush motor 36 will not start and a valve 38 remains closed to inhibit the solution spray until the deadman lever 37 is squeezed to start the drive motor 15. When the deadman lever 37 is squeezed, the carpet cleaner is propelled across the carpet, the valve 38 is opened to spray cleaning solution from the spray jet bar 25 onto the carpet, the brush 26 scrubs the wet carpet and the vacuum shoe subsequently extracts dirt and solution from the carpet. Whenever necessary, the recovery tank 28 is emptied. The recovery tank 28 preferably includes a float mechanism to prevent over filling.

Figure 2:
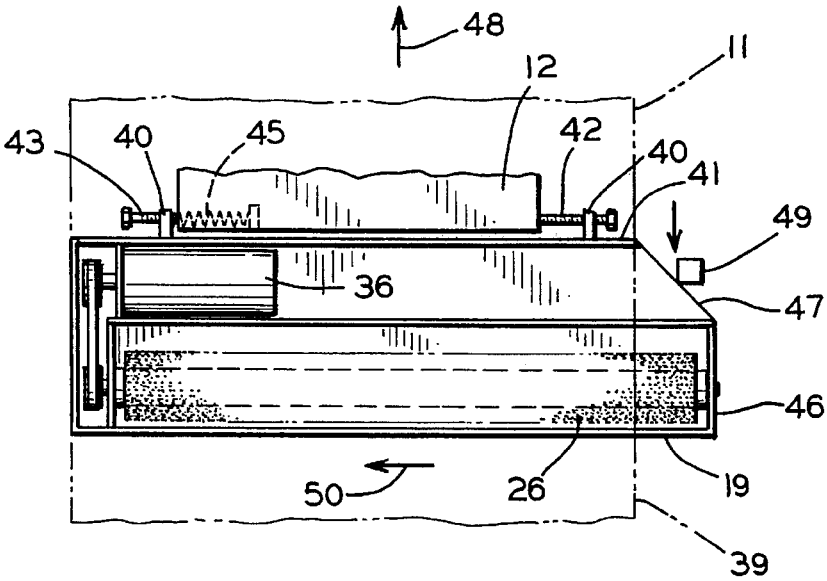
FIG. 2 is a fragmentary top plan view showing the carpet brush housing with its cover removed and showing mounting details for the carpet brush housing.
Figure 3:
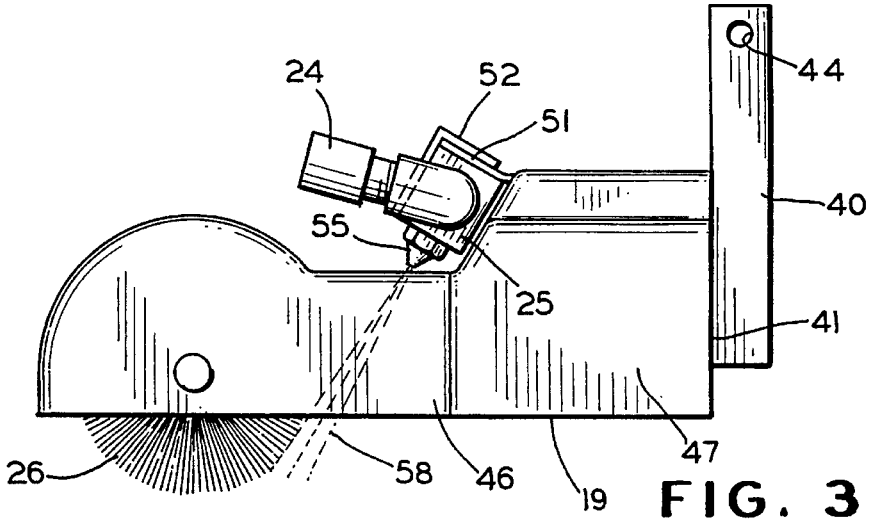
FIG. 3 is a side elevational view of the carpet brush housing with an attached solution spray jet bar.

For carpet cleaning with minimum hand labor, it is desirable to have the capability of operating the carpet cleaner 10 close to walls, furniture, and the like. However, this can increase the risk of damage to the walls, etc. According to the invention, the brush housing 19 is mounted on the chassis 12 to extend from the right side 39 of the lower housing 11 to allow cleaning close to walls and furniture. As shown in FIGS. 1–3, a pair of spaced hanger brackets 40 are secured to a front 41 of the brush housing 19. Two bolts 42 and 43 pass through holes 44 in the brackets 40 and are secured to the chassis 12. The brackets 40 have a greater spacing than the adjacent portion of the chassis 12 and the bolts 42 and 43 are of sufficient length to allow the brush housing 19 to slide in a direction transverse to the lower housing 11. A spring 45 is connected between the chassis 12 and either one of the brackets 40 or the brush housing 19 to urge an end 46 of the brush housing 19 to extend from the right lower housing side 39. A surface 47 connects the housing end 46 to the housing front 41. The surface 47 is angled relative to the path 48 of forward movement of the carpet cleaner 10. In the event that the brush housing 19 strikes an obstacle, such as a furniture leg 49, the angled housing surface 47 causes the brush housing 19 to deflect on the bolts 42 and 43 in a direction 50 against the force of the spring 45. As a consequence of the deflection of the brush housing 19, the risk of damage to the furniture leg 49 or to a wall or other obstacle is minimized, while the carpet cleaner 10 is capable of cleaning close to furniture and walls.

Figure 4:
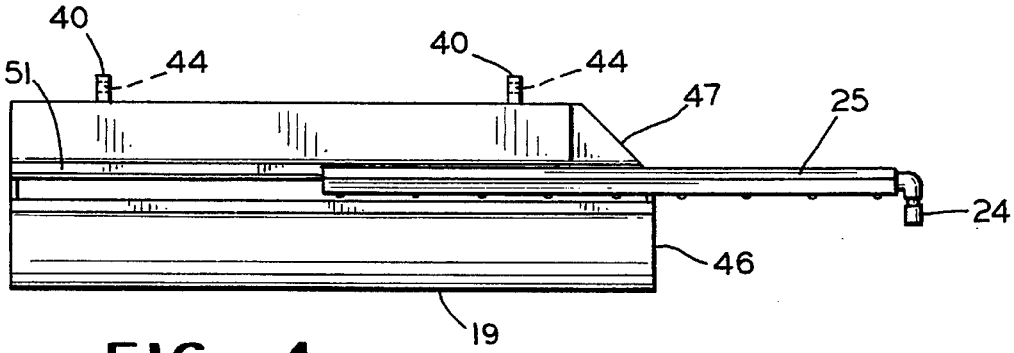
FIG. 4 is a partially broken away top plan view of the carpet brush housing showing the solution spray jet bar partially withdrawn from the housing.
Figure 5:
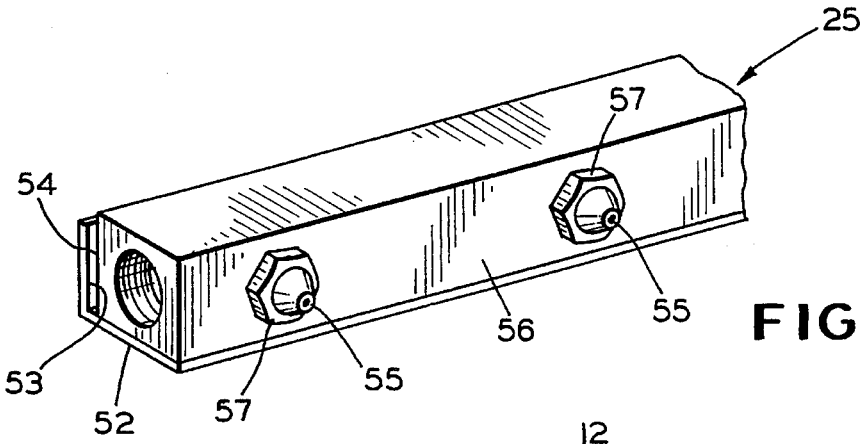
FIG. 5 is an enlarged fragmentary perspective view of the solution spray jet bar with the hose connection fittings removed.

FIGS. 1 and 3–5 show details of the solution spray jet bar 25. The spray jet bar 25 is generally a tube having a square exterior and a length substantially the same as the width of the brush housing 19. A rigid flange 51 extends the full width of the brush housing 19 for mounting the spray jet bar 25. An angled bracket 52 is secured along the length of the spray jet bar 25. The bracket 52 has a side 53 which is spaced from a side 54 of the spray jet bar 25 for receiving the brush housing flange 51. As best seen in FIGS. 3 and 4, the spray jet bar 25 slides in an axial direction onto the flange 51 for mounting the spray jet bar 25 on the brush housing 19. When the portions of the quick connect fitting 24 on the hose 23 and the spray jet bar 25 are connected together, the spray jet bar 25 is retained on the flange 51.

A plurality of nozzles 55 are secured along a side 56 of the spray jet bar 25. During use, the nozzles 55 may become clogged, for example, from dried cleaning solution or dirt. The nozzles 55 may be threaded directly into complimentary threaded openings (not shown) in the bar side 56, or they may be secured to adapters 57 which in turn are secured to the bar side 56. Preferably, a quarter turn connection, such as a bayonet type connection, is provided between the nozzles 55 and the adapters 57 to permit manual removal of the nozzles 55 without a wrench or other tool. This allows the worker using the carpet cleaner 10 to quickly remove a clogged nozzle 55 from the spray jet bar 25 for cleaning or replacement. When the spray jet bar 25 is mounted on the brush housing 19, the nozzles 55 are located to direct a solution spray 58 onto the carpet ahead of the brush 26 to wet the carpet prior to beating with the brush 26.

Figure 6:
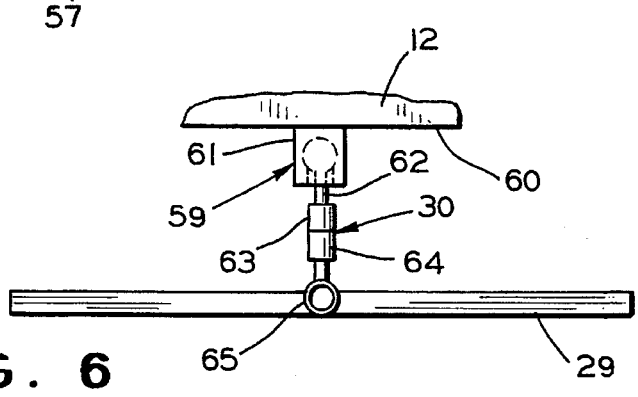
FIG. 6 is a fragmentary top plan view showing mounting details for attaching the vacuum shoe to the carpet cleaner.

Details for the mounting of the vacuum shoe 29 are shown in FIG. 6. A ball joint 59 is secured to a rear portion 60 of the chassis 12 for vertical movement. The lever 31 and cable 32 (FIG. 1) control the vertical position of the ball joint 59 on the chassis 12. The ball joint 59 has a side 61 secured to the chassis 12 and has a free side 62 attached to one side 63 of the quick connect fitting 30. A second side 64 of the quick connect fitting 30 is secured to the vacuum shoe 29. The quick connect fitting 30 may be a conventional quick connect hose connector, except that it is used only to establish a releasable mechanical connection and not to connect fluid passages. A sleeve 65 secured to the top of the vacuum shoe 29 communicates with the interior of the vacuum shoe 29. A cuff 66 on a free end of the vacuum hose 33 slides onto the sleeve 65 for connecting the vacuum shoe 29 to the recovery tank 28. During normal operation, the vacuum shoe 29 is releasably secured to the carpet cleaner by means of the quick connect coupling 30 and the hose cuff 66 is attached to the sleeve 65. The ball joint 59 and the weight of the vacuum shoe 29 allows a lower inlet edge 67 on the vacuum show 29 to float over the carpet as the carpet cleaner 10 is driven across the carpet. By maintaining a close contact between the edge 67 and the carpet, the extraction is enhanced. The ball joint 59 allows the vacuum shoe 29 to carpet irregularities, such as a carpet seam or a carpet edge, to maintain complete suction throughout the cleaning operation. Further, the vacuum shoe 29 swings and swivels on turns to ensure maximum vacuum coverage of the scrub path. The quick disconnect fitting 30 permits removal of the vacuum shoe 29 for cleaning.

Figure 7:
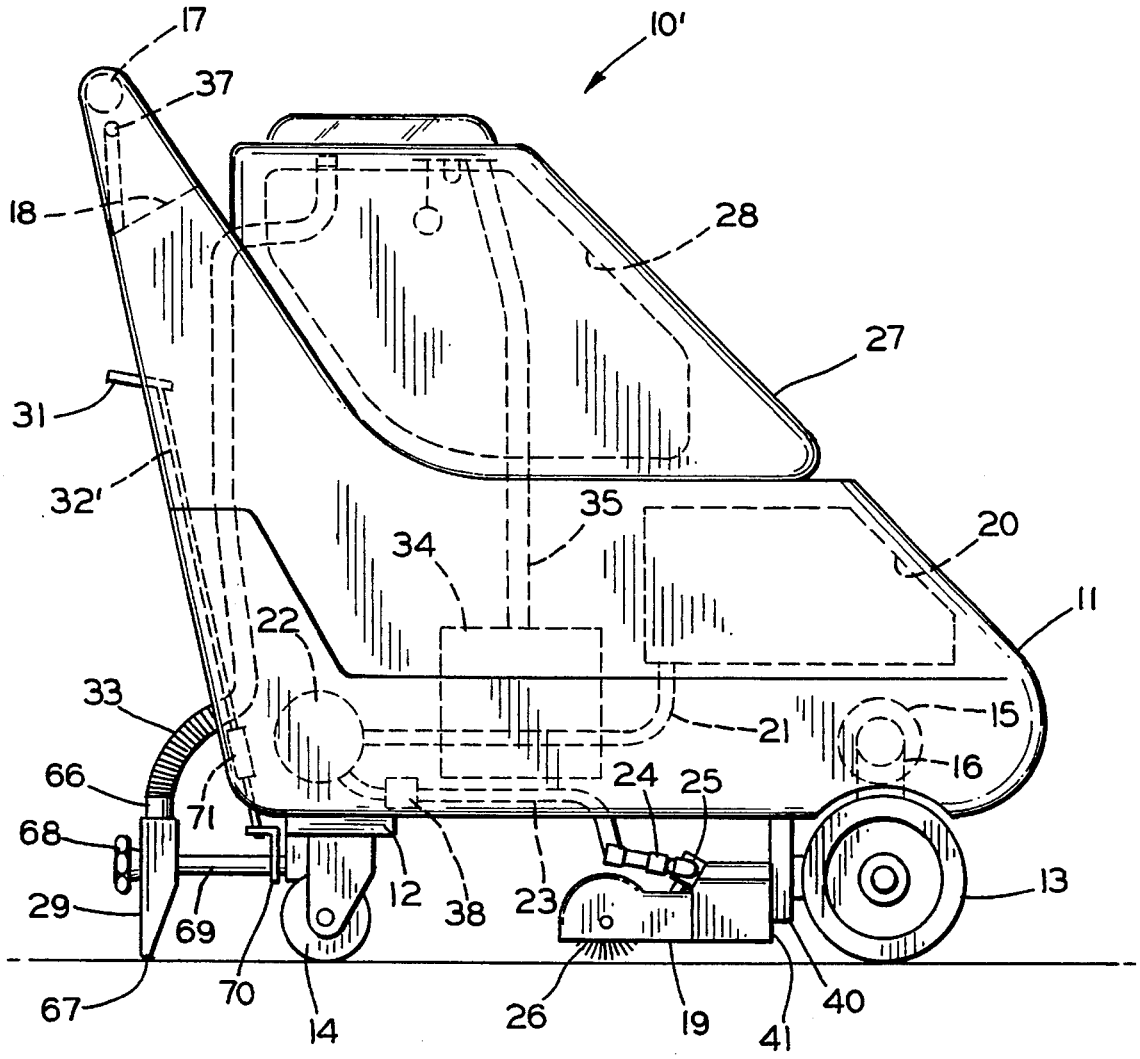
FIG. 7 is a side elevational view of a modified floor or carpet cleaner according to the invention.
Figure 8:
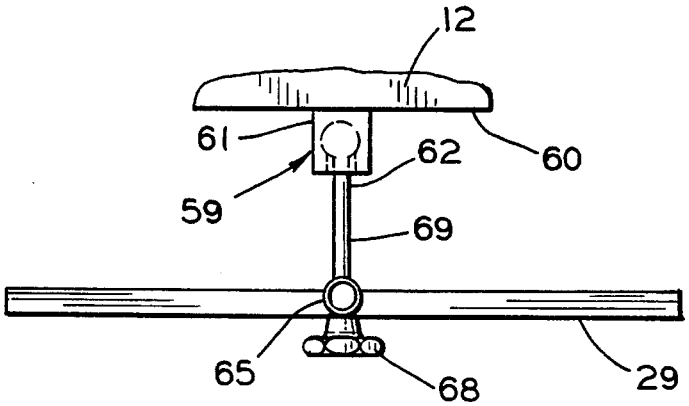
FIG. 8 is a fragmentary top plan view, similar to FIG. 6, but showing modified mounting details for attaching the vacuum shoe to the carpet cleaner.

FIGS. 7 and 8 illustrate modifications to the carpet cleaner

10'. In FIGS. 7 and 8, components identical to those previously described will be identified with the same references numbers. In the modified carpet cleaner 10' the quick disconnect 30 for attaching the vacuum shoe is replaced with a knob 68 threaded onto a rod 69. The rod 69 is attached to the ball joint 59 to permit the vacuum shoe 28 to rotate and pivot into contact with the floor. The vacuum shoe 59 may be removed for cleaning, or for storage or transporting the carpet cleaner 10' simply by unscrewing the knob 68 form the rod 69.

FIG. 7 also illustrates a modified structure for raising and lowering the vacuum shoe 29. The cable 32 is replaced with a rigid rod 32' connected between the lever 31 and a bracket 70 secured to the rod 69. A compression spring 71 is located in the rod 32'. The compression spring 71 is preferably a gas spring. The compression spring 71 is designed to permit lifting of the vacuum shoe 29 from the floor without compress the spring 71. When the lever 31 is moved to lower the vacuum shoe 29 into contact with the floor, the compression spring 71 is partially compressed to urge the lower edge 67 of the vacuum shoe 29 against the floor. Consequently, there is less tendency for the vacuum shoe 29 to bounce as the lower edge 67 is moved over a rough or irregular surface.

The above described carpet cleaner 10 has several improvements over prior art floor cleaning apparatus. The laterally moveable mounting for the brush housing 19 facilitates cleaning carpet close to walls, furniture and other objects with minimal risk of damage. Further, the solution spray jet bar 25 is easily removed from the carpet cleaner 10 for nozzle cleaning or replacement of jets simply by disconnecting the quick connect fitting 24 and withdrawing the spray jet bar 25 from the brush housing 19. Finally, an improved mount for the vacuum shoe 29 allows the vacuum shoe 29 to maintain maximum contact with the carpet during cleaning and also facilitates quick removal for maintenance. It will be appreciated that various modifications and changes may be made in the above described carpet cleaner 10 and from similar floor cleaning apparatus without departing from the spirit and the scope of the following claims.

We claim:

1. A floor cleaning apparatus comprising:

a chassis;

means for facilitating movement of said chassis relative to a floor along a path of movement;

means for vacuuming the floor, said means for vacuuming including a vacuum shoe for extracting matter from the floor; and means for releasably securing said vacuum shoe to said chassis, said means for releasably securing including a ball and socket mechanism connected between said chassis and said vacuum shoe for permitting movement of said vacuum shoe relative to said chassis, said means for releasably securing further includes a rod having a threaded end extending from said ball and socket mechanism through an aperture formed through said vacuum shoe, and an enlarged knob threaded onto said threaded end of said rod for permitting quick removal of said vacuum shoe from said chassis.

2. The floor cleaning apparatus defined in claim 1 wherein said means for releasably securing further includes a quick connect fitting connected between said ball and socket mechanism and said vacuum shoe for permitting quick removal of said vacuum shoe from said chassis.

3. The floor cleaning apparatus defined in claim 1 further including means for changing the vertical position of said vacuum shoe relative to said chassis.

4. The floor cleaning apparatus defined in claim 3 wherein said means for changing the vertical position of said vacuum shoe relative to said chassis includes a handle pivotably supported on said chassis and a member extending between said handle and said ball and socket mechanism, whereby pivoting movement of said handle causes vertical movement of said vacuum shoe.

5. The floor cleaning apparatus defined in claim 4 wherein said member is a flexible cable.

6. The floor cleaning apparatus defined in claim 4 wherein said member is a rigid shaft.

7. The floor cleaning apparatus defined in claim 6 wherein said member further includes a gas spring mechanism connected between said rigid shaft and said vacuum shoe.

8. A floor cleaning apparatus comprising:

a chassis;

means for facilitating movement of said chassis relative to a floor along a path of movement;

a housing supported on said chassis;

a spray jet bar including a plurality of spray nozzels;

means for telescopically receiving and supporting said spray jet bar in said housing including a flange formed on said housing and a groove formed on said spray bar, said flange being inserted within said groove when said spray jet bar is received and supported within said housing; and means for delivering a pressurized flow of a cleaning fluid to said spray nozzles on said spray jet bar.

9. The floor cleaning apparatus defined in claim 8 further including means for releasably retaining said spray jet bar in said housing.

10. The floor cleaning apparatus defined in claim 9 wherein said means for releasably retaining said spray jet bar in said housing includes a fluid delivery hose adapted to supply said pressurized flow of a cleaning fluid to said spray nozzles and means for releasably connecting said fluid delivery hose to said spray jet bar, said fluid delivery hose retaining said spray jet bar in said housing when connected to said spray jet bar.

11. A floor cleaning apparatus comprising:

a chassis;

means for facilitating movement of said chassis relative to a floor along a path of movement;

means for vacuuming the floor, said means for vacuuming including a vacuum shoe for extracting matter from the floor;

means for releasably securing said vacuum shoe to said chassis, said means for releasably securing including a ball and socket mechanism connected between said chassis and said vacuum shoe for permitting movement of said vacuum shoe relative to said chassis; and means for changing the vertical position of said vacuum shoe relative to said chassis including a handle pivotably supported on said chassis, a member connected to said handle for movement therewith, and a gas spring mechanism connected between said member and said ball and socket mechanism, whereby pivoting movement of said handle causes vertical movement of said vacuum shoe.

12. The floor cleaning apparatus defined in claim 11 wherein said member is a flexible cable.

13. The floor cleaning apparatus defined in claim 11 wherein said member is a rigid shaft.

14. The floor cleaning apparatus defined in claim 11 wherein said means for releasably securing further includes a quick connect fitting connected between said ball and socket mechanism and said vacuum shoe for permitting quick removal of said vacuum shoe from said chassis.

15. The floor cleaning apparatus defined in claim 11 wherein said means for releasably securing further includes a rod having a threaded end extending from said ball and socket mechanism through an aperture formed through said vacuum shoe, and an enlarged knob threaded onto said threaded end of said rod for permitting quick removal of said vacuum shoe from said chassis.

* * * * *